United States Patent [19]

Dekeister et al.

[11] 4,064,033

[45] Dec. 20, 1977

[54] ELECTROLYTIC CELL FOR ELECTROLYTICALLY PREPARING A METAL IN PULVERULENT FORM

[75] Inventors: Roger Dekeister; Gilbert Lemaire; Daniel Marzys, all of Auby-lez-Douai, France

[73] Assignee: Compagnie Royale Asturienne des Mines, Paris, France

[21] Appl. No.: 566,111

[22] Filed: Apr. 8, 1975

[30] Foreign Application Priority Data

Apr. 12, 1974 France ..... 74.12912
May 29, 1974 France ..... 74.18539

[51] Int. Cl.[2] ..... C25C 5/02; C25C 7/00; C25C 7/08

[52] U.S. Cl. ..... 204/275; 204/10; 204/269

[58] Field of Search ..... 204/10, 23, 222, 273, 204/275, 269

[56] References Cited

U.S. PATENT DOCUMENTS

| | | | |
|---|---|---|---|
| 521,991 | 6/1894 | Sachs et al. | 204/10 |
| 3,141,840 | 7/1964 | Melse et al. | 204/10 |
| 3,194,749 | 1/1965 | Furness | 204/10 |
| 3,428,543 | 2/1969 | Weber | 204/23 |
| 3,577,324 | 5/1971 | Patterson | 204/23 |
| 3,703,446 | 11/1972 | Haycock et al. | 204/23 |

*Primary Examiner*—T. M. Tufariello
*Attorney, Agent, or Firm*—Young & Thompson

[57] ABSTRACT

A method and apparatus for electrolytically preparing in an electrolytic cell metal, preferably zinc, in pulverulent form from a compound of the metal, for example, zinc oxide, in an aqueous ionized solution, for example potassium hydroxide of a concentration of 100 to 800 g/l, the solution preferably containing 10 to 350 of zinc per liter. The cathode at the bottom of the electrolytic cell comprises a layer of the same pulverulent metal, for example zinc, into which a grid cathode current input is introduced, the cathode current applied being sufficient to prevent the formation of metal in continuous form, preferably between 8 and 18 A/dm$^2$. The anode is disposed in the cell above the cathode. New solution is injected about the lower periphery of the cell so as to set the solution and pulverulent metal is turbulent suspension. The suspension is drawn off by a pump and allowed to settle in a settling tank the pulverulent metal being removed by a conveyor screw, the solution spilling over into a storage tank and then being pumped back to the cell and reintroduced by the injectors. A plurality of cells may be arranged in a stack or columns, operating sequentially, and utilizing the same settling tank, associated pumps, and other auxiliary equipment.

22 Claims, 4 Drawing Figures

ELECTROLYTIC CELL FOR ELECTROLYTICALLY PREPARING A METAL IN PULVERULENT FORM

The present invention relates to electrolytically preparing metal in pulverulent form from a compound of the metal in an ionized solution, and an electrolytic cell for preparing the metal.

When a metal must be used in its pulverulent form, it is economically advantageous to prepare it in a form which enables easy pulverisation, or even, which prepares it directly in pulverulent form. This is particularly the case with zinc.

It has been proposed to prepare zinc in pulverulent form from alkaline solutions of zinc oxide. However, the zinc obtained by electrolysis of such solutions with conventional cathodes is a spongy deposit of fragile dendrites which adheres poorly to the cathode. In order to recover the deposit and transform it into pulverulent form, rotary drum cathodes with scrapers have been employed. The deposit of spongy structure is progressively rolled while scraping the drum. The rolled sheets which come loose from the drum are later ground. The spongy structure, the poor adherence of the deposit, and consequently the variable thickness of the deposit are all unfavorable to continuous removal without breaks in the rolled sheet, and to uniform grinding thereof.

It has also been proposed to obtain zinc directly in pulverulent form by depositing it on a vibrating cathode, the zinc then coming loose from the cathode in granular form in response to the vibrations. The structure of the deposit and irregularities in adherence to the vibrating cathode lead to uncertain results. Further, for production on an industrial scale, the mechanical complexities and the energy requirements seem prohibitive.

An object of the present invention is to overcome the drawbacks of known methods of preparing metal in pulverulent form.

A further object of the invention is to prepare metal, directly, in uniform, fine, powdery form which is easily recoverable.

A more specific object consists in electrolytically preparing a metal in pulverulent form from a compound of the metal in an ionized solution in which the improvement comprises: forming a cathode of a bed of the metal in pulverulent form, conducting electrolysis so as to favor a pulverulent deposition, and recovering the metal powder thus deposited.

The electrolysis is conducted so that the current density applied at the cathode is greater than that for depositing a continuous layer of the metal, for a given metal, concentration of constituents, and temperature.

The above method is particularly useful when zinc is the metal.

Preferably, the ionized solution of a zinc compound is an aqueous alkaline solution of zinc oxide.

Preferably, the ionized solution contains 10–350 g of dissolved zinc oxide per liter of an aqueous solution of potassium hydroxide having a concentration of 100–800 g per liter, and the current density applied by the effective cathode is between 8 and 18 A/dm$^2$.

Another aspect of the present invention is preparing pulverulent metal in which the metal is periodically put into turbulent suspension in an ionized solution, removing the suspension and replacing it with fresh ionized solution, separating the constituents of the suspension thus removed, recovering the separated pulverulent metal and recycling the separated ionized solution.

As soon as the turbulence in the cell has ceased, the remaining pulverulent metal settles to reconstitute the cathode bed of pulverulent metal. Further, the separation of the constituents of the suspension into metal powder and ionized solution may be performed outside the cell while the latter is in operation.

The pulverulent metal is preferably put in turbulent suspension by injecting fresh ionized solution, and the constituents of the solution are separated by letting the pulverulent metal settle out of the ionized solution. Thus, the putting of the pulverulent metal in suspension is part of the same operation with the replacement of the suspension and the separation of the constituents of the suspension.

The invention comprises is an electrolytic cell in which the cathode comprises a bed of pulverulent metal with a cathode current input means formed as a grid in the midst of the bed and a noncorrodable anode disposed above the cathode.

Preferably the cathode current input means is of the same metal as the deposited metal, or an alloy thereof.

According to a preferred embodiment, the cathode current input means or grid is coated with a layer of the same metal as deposited.

The anode is preferably flat, perforate and arranged horizontally in the cell. The anode is preferably made of stainless steel.

A further object of the invention consists in an apparatus for electrolytically producing and recovering pulverulent metal from an ionized solution containing a compound of the same metal, comprising at least one electrolysis cell with a cathode including a bed of powder of the same metal and a cathode current input means formed as a horizontal grid disposed in the bed of the powder, in which the improvement comprises, in combination with the said cell, means for supplying ionized solution including a storage tank and solution circulating means immersed in the storage tank and injecting the ionized solution through at least one injector, and drawing off means for moving a suspension of the pulverulent metal in the solution from the cell and carrying it to a settling tank, the solution circulating means and the drawing off means being operable simultaneously and intermittently with equal flow rates.

Preferably, the solution circulating means and the drawing off means are coupled pumps adjusted to have the same flow rates, time control means actuating the pumps for predetermined periods with equal rest intervals.

According to a preferred arrangement the device comprises a cylindrical electrolytic cell with a vertical axis, a plurality of injectors regularly angularly disposed about the periphery of the cell in the vicinity of the cathode, and a suction tube extending from the vicinity of the anode along the vertical axis of the cell and to the drawing off means.

By means of this arrangement new ionized solution is injected in the vicinity of the cathode where the powdered metal is deposited and efficiently puts the powdered metal into suspension in the ionized solution, displacing the powdered metal from the periphery towards the axis of the cell, for the most part, where it is carried away by the suction tube.

The injectors are directed tangentially of the periphery of the cell, proximate to the cathode current inlet means, and define a direction of rotation. The injection of ionized solution thereby produces a vortex of solution coaxially of the cell which helps put the metal into suspension and makes the overall flow of the solution uniform, from the periphery towards the center.

Preferably, the anode is a horizontal disc remote from the periphery and covered on its upper face with an insulating coating, the suction tube passing through a central aperture in the anode and insulated at least along its parts in contact with the ionized solution. Since the anode is remote from the periphery of the cell it does not impede fluid flow from side to side of the anode. The insulating coating of the upper face of the anodic disc prevents current loss from the upper face and steadies the anodic current density, and consequently conditions for electrolysis. No secondary reactions are produced by contact with the insulating wall of the suction tube.

The cell preferably has at least one vertical groove in its inner peripheral surface, a conductor insulated from the cathode current input means or grid being received in the groove. Owing to this arrangement, the leads of the cathode grid do not project into the cylindrical cell and do not interfere with the vortical movement of the suspension while the new ionized solution is injected.

The settling tank is preferably provided with pulverulent metal extracting means for lifting the settled pulverulent metal from the bottom of the settling tank. Thus, the pulverulent metal can be removed from the settling tank continously.

According to a preferred arrangement, the settling tank has dihedral bottom walls with an inclined common edge, a conveyor or Archimedes' screw being the extraction means for the pulverulent metal and lying along said common edge. The settled powder collects around the common edge of the dihedral bottom wall from which it is carried away by the conveyor screw.

The settling tank advantageously has an overflow device spilling over into the solution storage tank. The recycling of the ionized solution is thus facilitated.

For preventing the pulverulent metal from floating on the surface of the settling tank due to bubbles of gas, the settling tank may be equipped with an agitator operative on the surface, proximate to the overflow device, which immerses the floating pulverulent metal.

The storage tank is preferably provided with means for adjusting the concentration of the ionized solution. The ionized solution which is depleted in metal ions, owing to the removal of the pulverulent metal, can be recharged to its initial ion concentration.

According to a preferred arrangement, the apparatus comprises a plurality of electrolysis cells in association with a single solution supply means and a single pulverulent metal extracting means, the circulating means and drawing off means sequentially being put into communication with one of the plurality of cells.

The coefficients of use of the circulation and drawing off means are thus increased by balancing the capacities of production of the cells and the extraction capacity of the extracting means.

The plurality of cells are preferably superpositioned in at least one vertical column. This stacking of cells in a vertical column results in savings of surface space.

The features and advantages of the invention will be brought out in the description which follows, given by way of example, with reference to the accompanying drawings, in which.

Figure 1:
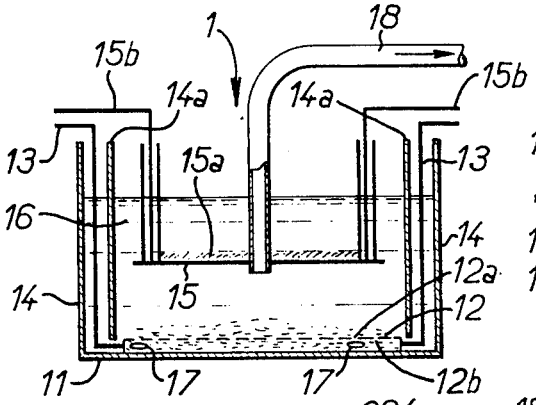
FIG. 1 is an elevational view, in section, of an electrolytic cell of the apparatus.
Figure 2:
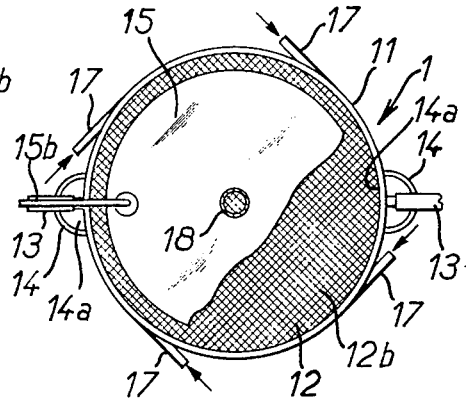
FIG. 2 is a top plan view of the electrolyte cell.

According to the illustrated embodiment of FIGS. 1 and 2, a generally cylindrical electrolytic cell, generally designated by reference numeral 1, comprises tank 11 of insulating material, a cathode 12 including a bed **12*a* of pulverulent metal, the same as that to be deposited, and cathode current input means 12*b* formed as a grid with square meshes in the midst of the bed of powder. The cathode current leads 13 received in vertical grooves 14 in the inner peripheral surface of the tank 11 permit the connection of the cathode 12 to the negative pole of a current generator (not shown). Panels 14*a* seal the grooves 14 and are continuous with the cylindrical inner wall of the tank 11. A horizontal disc-shaped anode 15 is centered along the axis of the tank 11 and has an insulating covering 15*a* on its upper face. The disc-shaped anode 15 is spaced radially from the cylindrical wall of the tank 11 leaving room for the passage of electrolyte 16 and gas therebetween. The leads 15*b*, insulated along their parts in contact with the electrolyte 16, enable the connection of the anode 15 with the positive terminal of a current generator (not shown). Four injectors 17 are disposed at right angles to one another and tangentially of the periphery of the tank 11 and all in a given direction of rotation, i.e. clockwise or counter-clockwise, in the area of the cathode 12, a little below the cathode current inlet lead means 12*b*. A suction tube 18 of insulating material extends along the axis of the tank and through a central aperture in the anode 15**. The tube has an elbow after leaving the tank, and extends horizontally thereafter.

Figure 3:
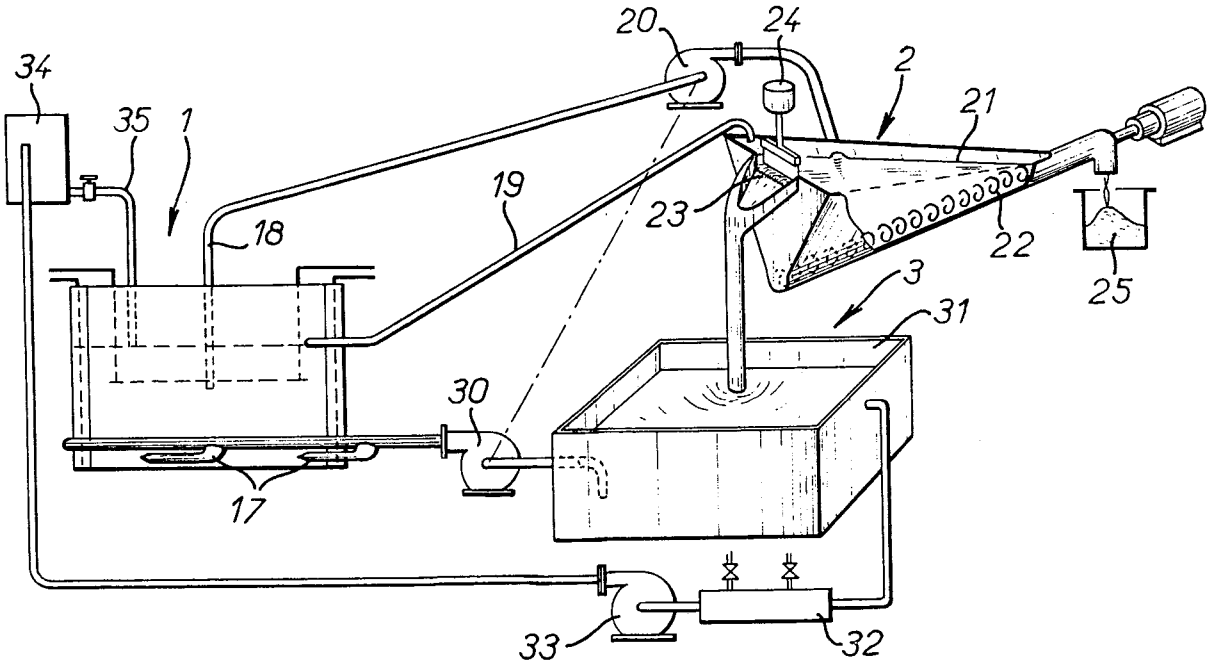
FIG. 3 is a schematic illustration of the entire apparatus, including the electrolytic cell.

As shown in FIG. 3, the tube 18 terminates at the admission side of a drawing off pump 20 which delivers the suspension of pulverulent metal in solution into a settling tank generally designated by reference numeral 2. The settling tank 2 includes a vat or tank 21 with a dihedral bottom and an inclined common edge. An Archimedes or conveyor screw 22 is disposed generally along the common edge of the dihedral bottom for raising settled pulverulent metal from the bottom of the settling tank 21 to a receptacle 25. An overflow device 23 determines the level of liquid in the settling tank. A slow agitator 24 is disposed proximate to the overflow device 23 and mixes the liquid near the surface. The overflow liquid from the settling tank spills over into a storage tank generally designated by reference 3. The liquid in the storage tank 3 can be recycled by the circulation pump 30 for carrying the liquid to the injectors 17 in the electrolytic cell 1. The storage tank 3 is providing with means for adjusting the concentration of the electrolyte including a mixing device 32 with nozzles for introducing the constituents of the electrolyte. A recovery pump 33 carries remixed solution to a supply tank 34 for supplying a continuous flow of electrolyte of readjusted concentration through conduit 35 into the cell 1. Another conduit 19 carries overflow from the cell to the settling tank.

The apparatus described with reference to FIGS. 1–3 operates in the following manner: The electrolysis is carried out so as to deposit pulverulent metal on the cathode 12 which causes the thickness of the initial bed of powder to increase. Periodically, electrically or mechanically coupled pumps 20 and 30 are turned on; the flow rates of the pumps are adjusted to be substantially equal, taking the loss of head and the displaced fluid densities into account. The injection of electrolyte, through tangential injectors 17, into the cell, proximate to the bed 12*a* of pulverulent metal, sets the contents of the cell into rotation thereby putting pulverulent metal into suspension in the electrolyte 16. The rotation or swirling of the contents of the cell is not interfered with by the leads 13 which are recessed in the cell wall. The simultaneous suction of suspension by drawing off pump through the suction tube 18 adds to the swirling movement of the suspension from the periphery towards the center of the cell. The suspension arrives in the settling tank 21, and the pulverulent metal settles to the bottom thereof from which it is carried away by conveyor screw 22 to the receptacle 25. Owing to the fact that gas is given off during the electrolysis, part of the pulverulent metal is entrained by bubbles of gas and carried to the surface where it floats. The slow surface mixing of the agitator 24 breaks the bond between the gas bubbles and the particles of pulverulent metal which are thus freed and settle to the bottom of the cell. The excess electrolyte spills over to the storage tank 3 via overflow device 23.

In order to check the operative conditions of the above-described method and apparatus of the invention trials were carried out under laboratory conditions as follows:

The experimental electrolytic cell was a large receptacle with a galvanized iron, 12mm square mesh grid on the bottom thereof. The grid has an input lead for connection with the negative terminal of a D.C. generator. A layer of powdered zinc was spread on the bottom of receptacle and slightly compacted; the surface of the layer was levelled for homogenizing the bed of powder which completely embedded the grid. An anode comprising a perforated plate of stainless steel with a lead for connection with the positive terminal of the A.C. generator was disposed parallel to and several centimeters above the cathodic bed.

An electrolyte with 30 g/l of zinc was prepared by dissolving a measure quantity of zinc oxide in an aqueous solution of potassium hydroxide having a concentration of 675 g/l. The electrolyte was poured into the cell so that the anode was substantially immersed therein. The electrolysis is conducted with an effective cathode current density of 12 A/dm$^2$ for the effective area of the bed without artificial heating or cooling.

After sufficient time the powder forming the cathode was collected and the grain sizes of the powder measured granulometrically. The results were as follows:

70%–100 $\mu$ grains

19%–40 $\mu$ grains

It should be noted that the granulometry or grain size distribution of the powder deposited was the same as that of the initial cathodic bed. Thus, pulverulent metal deposited in a cell can be used to constitute or reconstitute a cathodic bed. Consequently, the nature of the cathode does not change during deposition; the pulverulent zinc which is deposited can be recovered either intermittently or continuously without modifying the operating condition of the process.

Figure 4:
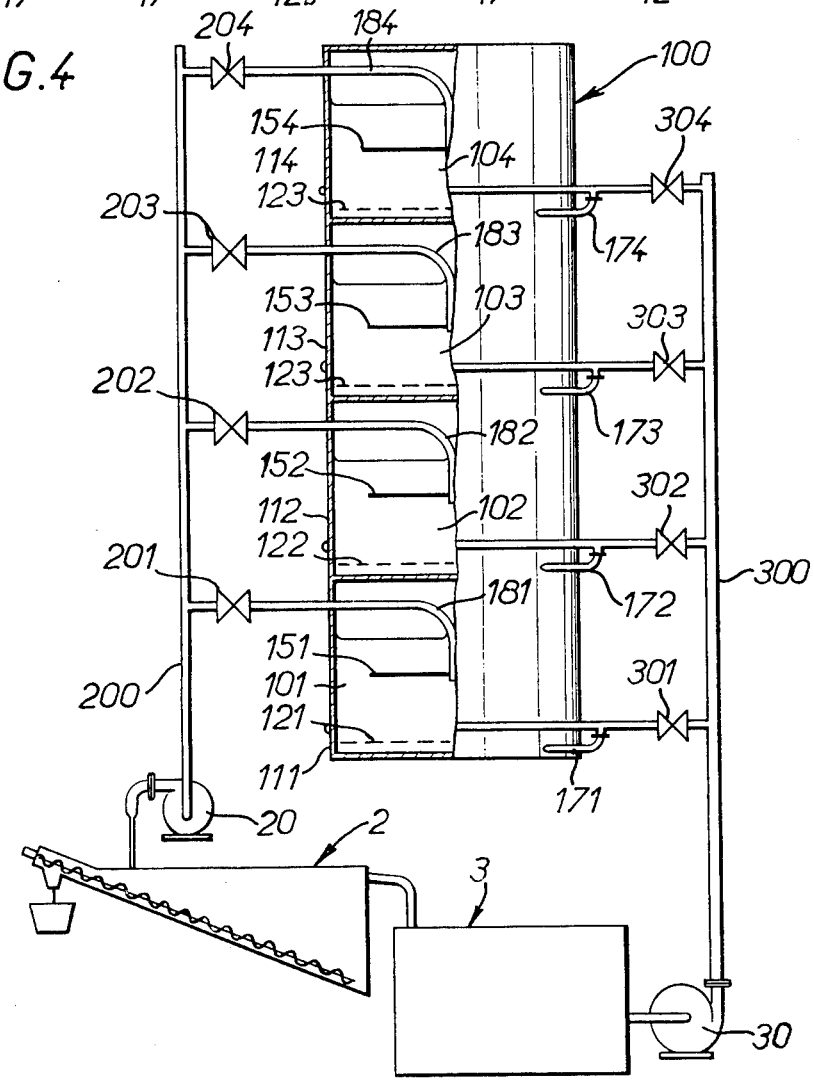
FIG. 4 is a schematic showing of a column of four superpositioned electrolytic cells.

In the arrangement shown in FIG. 4, four electrolytic cells 101, 102, 103, 104 are stacked and form a column 100. Each cell has a cathode bed of pulverulent metal 121, 122, 123, 124, a disc-shaped anode 151, 152, 153, 154, injectors 171, 172, 173, 174, and suction tubes 181, 182, 183, 184. A circulation pump carries liquid from the storage tank 3 and pumps it through a distributor pipe for communication with the injectors 171–174 individually by controlled valves 301–304. Similarly, drawing off pump 20 delivering liquid to a settling tank 2 creates a negative pressure in the distributor pipe 200 which can be connected individually to the suction tubes 181–184 through valves 201–204.

A program control device is connected to the pairs of coupled valves 201 and 301, 202 and 302, 203 and 303, and 204 and 304 for opening a first pair of valves for a given time period while all the other valves are closed and then closing the first pair of valves and opening a second pair of valves for the same time period, and so on. A suitable program control device comprises a plurality of cam discs driven by a synchronous motor, the operative cam sectors of the cam disc being circumferentially offset from one another and each associated with a switch connected to one of the pairs of electrically controlled valves for opening and closing them. The operative cam sectors are of equal length and equally spaced so that the pairs of valves are opened sequentially for a predetermined period and then closed for a predetermined interval.

Accordingly, the corresponding cells are operative sequentially so that pulverulent metal is successively deposited in a first cell, put into suspension therein, and then carried away to the settling tank, and next deposited in a second cell, put into suspension therein and then carried away to the settling tank, and so on.

With a stack of cells having a single settling tank and a single storage tank and removing the pulverulent metal sequentially from each cell, the production capacity of the stack of cells and the pulverulent metal extraction capacity of the settling tank are balanced.

According to a typical example of preparation and removal of pulverulent zinc from a solution of zinc oxide in potassium hydroxide, the conditions are as follows:

| | |
|---|---|
| Cells in a column | : 4 |
| Diameter of cells | : 0.4 m |
| Volume of electrolyte in each cell | : 18 l |
| Cathode current input means | : 12 mm square mesh grid of galvanized iron |
| Anode/Cathode spacing | : 8 cm |
| Electrolyte | : solution of zinc oxide with 30 g/l zinc in potassium hydroxide at 675 g/l |
| Cathodic current per cell | : 150 A |
| Current density | : 12 A/dm$^2$ |
| Duration of suspension removal from each cell | : 15 to 20 seconds |
| Removal period for each cell | : ½ hour |

Although the present description does not give certain structural details obvious to the man in the art, such as vents for venting the cells, means for controlling and adjusting the concentration of the electrolyte, the construction of the program control device or means for adjusting the electrolysis current, these details do not affect the scope or understanding of the present invention.

Moreover, the present invention is not limited to the illustrated examples and embodiments, various modifications being possible within the scope of the invention in respect of the separation of the pulverulent metal and electrolyte and arrangement of the plurality of cells.

Although the examples of the description concern the preparation of zinc by electrolysis of a dissolved solution of zinc oxide in concentrated potassium hydroxide, the composition of the electrolyte, its nature and the deposited metal could, naturally, all be different without going outside the scope of the present invention.

The cathode current input means is preferably a grid of the same metal as that to be deposited, or an alloy thereof, or even a grid coated with a layer of the metal to be deposited. The reason for the same is reduction or suppression of potential differences at the interface of the bed of pulverulent metal and the cathode current input. However, it is obvious that the choice of a metal different from the metal to be deposited for the cathode current input means would be within the scope of the present invention.

What we claim is:

1. Apparatus for preparing a pulverulent metal from a compound of the metal in an ionized solution, comprising an electrolytic cell for containing said ionized solution, a cathode for said cell consisting of a bed of powder of metal to be deposited, said bed being settled at the bottom of said cell, current input means disposed in the midst of said cathode bed for supplying current to said bed of powder, a noncorrodable anode in said cell above the cathode, said electrolytic cell being cylindrical with a vertical axis, a plurality of injectors disposed at regular intervals about the periphery of said electrolytic cell adjacent said cathode, said injectors being tangential to said electrolytic cell and directed so that they all inject said solution in the same angular direction, means for supplying said solution to said injectors, whereby injection of said solution through said injectors causes vortical flow of said solution in said cell with suspension of metal powder in a central portion of said cell, and means for withdrawing said solution with said metal powder suspended therein from said central portion of said cell.

2. Apparatus according to claim 1, wherein said cathode current input means is formed of the aforesaid metal.

3. Apparatus according to claim 1, wherein said cathode current input means is formed of an alloy of the aforesaid metal.

4. Apparatus according to claim 1, wherein said cathode current input means is coated with the aforesaid metal.

5. Apparatus according to claim 1, wherein said anode is a flat, perforate and horizontally oriented disc.

6. Apparatus according to claim 1 for preparing zinc powder from zinc oxide dissolved in an aqueous solution of potassium hydroxide, wherein said bed consists of zinc powder settled on the bottom of said cell.

7. Apparatus according to claim 6, wherein said anode is made of stainless steel.

8. Apparatus according to claim 1, further comprising means for supplying ionized solution to the electrolytic cell including a storage tank, circulating means for drawing off solution from said storage tank and pumping it to injection means in said electrolytic cell for putting said cathode bed intermittently in turbulent suspension, during which withdrawal of said suspension occurs, and means for drawing off a part of the suspension from said electrolytic cell and discharging it into a settling tank, thereby removing excess pulverulent metal which has accumulated on said bed during previous deposition, said circulating means and drawing off means having substantially equal flow rate, and means for coupling said circulating means and said drawing off means for intermittent simultaneous operation.

9. Apparatus according to claim 8, wherein said circulating means and said drawing off means are pumps, time control means being associated with both said circulating means and said drawing off means for intermittent operation, including a predetermined operative period, preceded and followed by equal rest intervals.

10. Apparatus according to claim 8, comprising further a suction tube extending vertically from said anode and connected to said drawing off means.

11. Apparatus according to claim 10, wherein said anode is a horizontal disc, an insulating coating provided on the upper face of said anode, said suction tube extending through an aperture in said anode and insulated along a portion thereof in contact with the solution in said cell.

12. Apparatus according to claim 10, wherein an insulated lead connected to said cathode current input means extends along a recess in the side wall of said cell, said recess being covered with a panel for separating it from the solution in said cell.

13. Apparatus according to claim 8, wherein means for removing settled pulverulent metal from said settling tank is provided at the bottom of said settling tank.

14. Apparatus according to claim 13, wherein said last-mentioned means includes a conveyor screw, and the bottom of said settling tank has a dihedral surface, said conveyor screw being disposed along the common edge of the dihedral surface.

15. Apparatus according to claim 14, wherein said settling tank is also provided with overflow means for spilling solution from said settling tank into said storage tank.

16. Apparatus according to claim 15, wherein said settling tank has an agitator near said overflow means.

17. Apparatus according to claim 8, wherein said storage tank is provided with means for adjusting the concentration of the ionized solution.

18. Apparatus according to claim 8, wherein a plurality of said electrolytic cells are provided, each of said electrolytic cells being associated with the said means for supplying ionized solution and the said means for removing the suspension, and further comprising means for operating said electrolytic cells sequentially.

19. Apparatus according to claim 18, wherein the plurality of electrolytic cells are superposed in at least one vertical stack or column.

20. Apparatus according to claim 1, said withdrawing means comprising a suction tube that extends down into a central portion of said cell.

21. Apparatus according to claim 20, said anode comprising a horizontal disc through which said suction tube extends.

22. Apparatus as claimed in claim 21, and an insulating coating on the upper side of said disc.

* * * * *